US005580020A

United States Patent [19]

Catchings

[11] Patent Number: 5,580,020

[45] Date of Patent: Dec. 3, 1996

[54] NAUTICAL DRINK HOLDER

[76] Inventor: Mike D. Catchings, 5008 Arbor Glen, The Colony, Tex. 75056

[21] Appl. No.: 419,145

[22] Filed: Apr. 10, 1995

[51] Int. Cl.[6] ..... A47K 1/08

[52] U.S. Cl. ..... 248/311.2; 248/315

[58] Field of Search ..... 248/311.2, 230.1, 248/218.4, 315, 289.11; 211/71, 88; D12/411, 114

[56] References Cited

U.S. PATENT DOCUMENTS

| | | | |
|---|---|---|---|
| D. 288,054 | 2/1987 | Schulte et al. | D7/70 |
| 3,269,683 | 8/1966 | Shinaver | 248/230 |
| 3,734,439 | 5/1973 | Wintz | 248/224 |
| 3,968,912 | 7/1976 | Horwitz | 224/36 |
| 5,320,263 | 6/1994 | Kobylack | 224/274 |
| 5,474,273 | 12/1995 | Vinal | 248/311.2 |

OTHER PUBLICATIONS

West Marine Catalog Sales—pp. 389 and 439.

*Primary Examiner*—Leslie A. Braun
*Assistant Examiner*—Willie Berry, Jr.
*Attorney, Agent, or Firm*—Crutsinger & Booth

[57] ABSTRACT

A container holding device arranged for being removably mounted to a pole or the like. The frame has a support plate having thereon an upper and a lower end, and a first and second oppositely disposed faces. The first clamp has a first pair of adjacent fingers extending from the first face. The fingers are adapted for removably mounting the device to a first pole. The first container compartment has a first retaining member extending from the second face and has an aperture extending therethrough. The second clamp extends from the first face. The second clamp has a first resilient hook member adapted for removably mounting the device to a second pole. The hook member and the first face defines a slot and has a slot surface contoured to match a profile of the second pole.

8 Claims, 4 Drawing Sheets

NAUTICAL DRINK HOLDER

FIELD OF THE INVENTION

A device is provided for holding containers that is mountable to a post, pole or the like. More particularly, a device is provided which comprises a clamp which is easily installed onto and removed from the post, and a container compartment or a plurality of container compartments adapted to hold beverage containers.

BACKGROUND OF THE INVENTION

Drink holders or beverage container holders are found throughout the prior art, and particularly holders are found which are suited for use in conjunction with recreational activities.

U.S. Pat. No. 5,320,263 to Kobylack discloses a Golf Cart Beverage support. The support uses an encircling band or clamp to support a beverage container from a tubular member.

A variety of beverage holders are found for use in nautical environments. Many of these devices comprise an upper plate with an aperture or plurality of apertures arranged therein adapted to receive a beverage container, and a lower plate positioned beneath the aperture or apertures to support the beverage containers. The plates are connected by a side plate extending therebetween which also provides a platform for a clamp or the like used to mount the device to a supporting structure.

Clamps are used to fasten such devices to posts which, for example, comprise two adjacent blocks hinged at one end and secured by a thumb-screw at the other. Each block has an elongated semi-circular depression formed in the face that contacts the opposing block. The depressions are aligned with each other to form a tubular opening extending through the blocks adapted for mounting to a rail or post or the like. The clamp is installed onto the rail by loosening the thumb screw and spreading the blocks apart. The blocks are then closed with the rail fitting into the depressions, and the thumbscrew is tightened.

From the foregoing discussion of the prior art, it is apparent that a need exists for a drink holder which could be easily secured to and removed from a tubular supporting structure.

SUMMARY OF THE INVENTION

In accordance with the present invention, a container holding device is provided which is easily mounted in a removable manner to a post, pole or the like. The presently preferred embodiment is especially suited for holding cylindrical beverage containers in nautical environments. Particularly, the device can be easily mounted to or removed from tubular structures on watercraft such as steering pedestals, lifeline stanchions, bow pulpipts, stern pulpits, mast support structures, and companionway and swim ladders. The device provides a reliable, simple and economical holder.

The one embodiment of the invention comprises a frame, a first clamp and a first container compartment. The frame comprises a rectangular support plate having upper and lower ends and first and second oppositely disposed faces. The first clamp comprises a pair of adjacent, resilient fingers extending from the first face of the support plate that are adapted for removably mounting the device to a first pole.

The first container compartment comprises a first retaining member and a first support flange, each of which extend from the second face of the support plate. The first support flange is positioned below the first retaining member and is adapted to contact the bottom surface of a container. The first retaining member has an aperture therein which is circular about a longitudinal axis extending through the center of the aperture, and is sized to accommodate a predetermined container, for example, a 12 ounce beverage bottle or can.

When a container is installed into the aperture, the first retaining member restricts movement of the container in directions perpendicular to the longitudinal axis extending through the aperture. The first support flange contacts the bottom surface of the container to prevent the container from falling through the aperture.

Additional embodiments of the invention include devices wherein the first clamp includes a second pair of fingers adapted for mounting to the first pole, devices adapted to mount to a pair of poles and which include a plurality of container compartments, devices which have a second container compartment pivotally attached to the first container compartment, and devices wherein the first clamp is pivotally attached to the frame. Other objects, advantages, and features of the present invention will become apparent upon consideration of the detailed description and drawings.

DESCRIPTION OF THE PREFERRED EMBODIMENT

Figure 1:
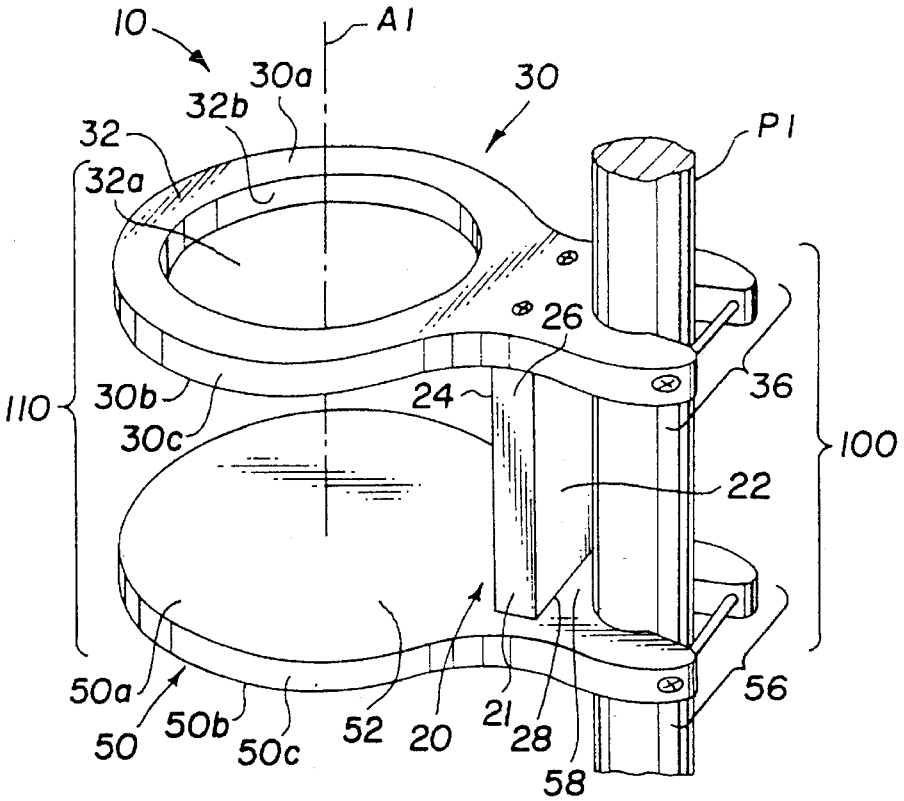
FIG. 1 is a perspective view of the preferred embodiment.
Figure 1A:
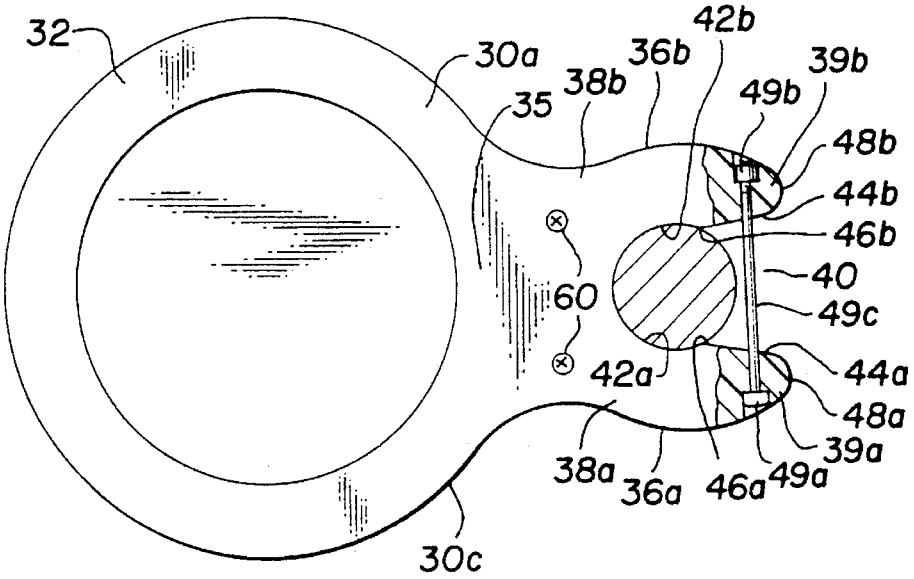
FIG. 1*a* is a top view of the preferred embodiment.

Referring to the drawing, where like parts are designated by like numbers in the various figures, a device according to the preferred embodiment is designated generally by the numeral 10. The device may be constructed from any conventional material, but a plastic material which is environmentally stabilized to resist harsh sun and sea conditions, including ultraviolet light, is preferred.

The device comprises a frame 20, an upper platform 30, and a lower platform 50. As discussed hereinafter, upper platform 30 and lower platform 50 are positioned on the frame 20 to form a first clamp 100 and a first container compartment 110.

Frame 20 comprises rectangular support plate 21 which has oppositely disposed first and second faces 22 and 24 and upper and lower ends 26 and 28.

Upper platform 30 has an upper surface 30*a*, a lower surface 30*b*, and an exterior surface 30*c*. A first retaining member 32 having an aperture 32*a* therein with aperture walls 32*b* extends perpendicular from the second face 24 near the upper end 26 of support plate 21. Aperture 32*a* is circular about central longitudinal axis A1 which is parallel with the support plate 21 and which extends through the center of the aperture 32*a*. The aperture 32*a* is sized and shaped to accommodate the container (not shown) to be held by the device. The term aperture as used in this specification is not limited to circular openings. It is anticipated that apertures with square, rectangular, elliptical, etc. cross sections may also be used.

First retaining member 32 is disposed on one side of a web member 35 which is adapted to mate with the upper end 26 of support plate 21. A first pair 36 of resilient fingers or arms 36*a* and 36*b* which are adapted for removably mounting the device to a first pole P1 is disposed on the opposite side of web 35. The fingers 36*a* and 36*b* are adjacent and extend generally perpendicularly from the first face 22 near the upper end 26 of support plate 21.

The fingers 36*a* and 36*b* have body portions 38*a* and 38*b* with ends 39*a* and 39*b* thereon, and the fingers define a gap 40 therebetween. The body portions have gap walls 42*a* and 42*b* which are contoured to match a profile of the pole PI. The ends 39*a* and 39*b* have gap walls 44*a* and 44*b* which diverge uniformly away from each other as they extend from clinch points 46*a* and 46*b* to the extreme ends 48*a* and 48*b*. The distance between the gap walls at the clinch points is slightly less than the diameter of the pole P1, and the distance between the gap walls at extreme ends 48*a* and 48*b* is larger than the diameter of the pole P1. In the presently preferred embodiment, the gap 40 between body portions 38*a* and 38*b* is slightly smaller than the pole P1. Alternatively, the gap 40 might be made the same size or slightly larger than the pole.

Finger 36*a* includes a bolt hole 49*a*, while finger 36*b* includes a threaded insert 49*b* . The hole 49*a* and insert 49*b* are in alignment, and an adjustable threaded connector 49*c* installed in the counter-bored hole 49*a* extends across gap 40 and into threaded insert 49*b*. The hole 49*a* is counter-bored deep enough to permit the threaded member 49*c* to lie flush with or below the exterior surface 30*c*.

Lower platform 50 is provided with an upper surface 50*a*, a lower surface 50*b*, and an exterior surface 50*c*. Lower platform 50 has a first support flange 52 where upper surface 50*a* is adapted to contact the bottom surface of the container. The first support flange 52 extends perpendicularly from the second face 24 near the lower end 28 of support plate 21. Lower platform 50 has a second pair 56 of fingers 36*a* and 36*b*, which extend perpendicularly from the first face 22 near the lower end 28 of support plate 21. The first support flange 52 and second finger pair 56 are disposed on opposite sides of a web member 58 adapted to mate with the lower end 28 of support plate 21.

Upper platform 30 and lower platform 50 are secured at webs 36 and 58 to opposite ends 26 and 28 of support plate 21. The pieces are secured using screws 60 or by any other conventional means known to those skilled in the art. In the presently preferred embodiment, the screw holes are counter-bored to set the screw 60 flush with or below the upper surface 30*a* on the upper platform 30, and the lower surface 50*b* on the lower platform 50. It is to be understood that elements described hereinafter as being secured by screws 60 are similarly secured using counterbored holes or by any other means known to those skilled in the art.

In the presently preferred embodiment, upper and lower platforms 30 and 50 are secured to support plate 21 with the first and second pair of fingers 36 and 56 aligned to form a first clamp 100 for mounting to and gripping the pole P1 at two different places. According to further embodiments of the invention, a first clamp 100 comprising only one pair of fingers might be provided. Such an embodiment may be made in various ways, for example, by eliminating either pair of fingers 36 or 56, or by eliminating both pair of fingers 36 and 56, and forming the fingers integrally with the support plate 21. In the presently preferred embodiment, the aperture 32*a* in first retaining member 32 is aligned with and positioned above the first support flange 52 to form a first container compartment 110.

Figure 2:
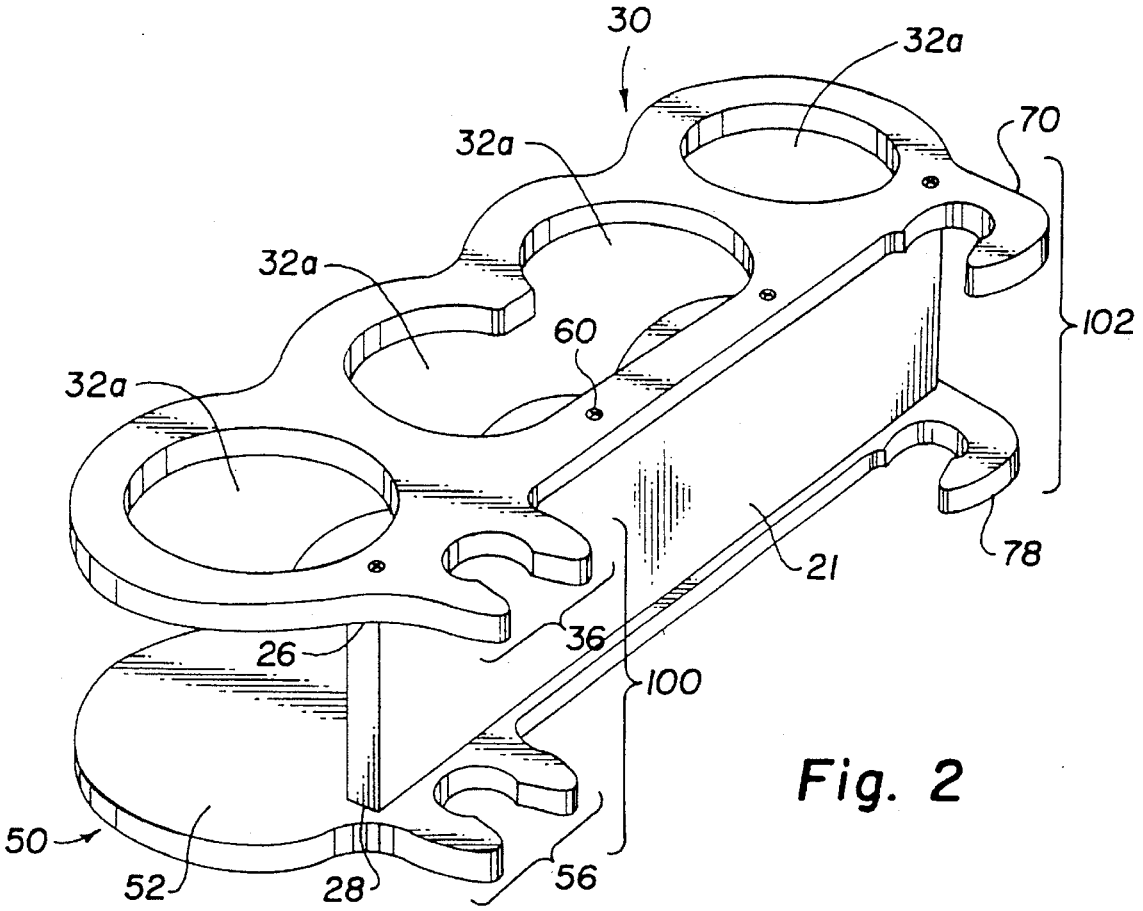
FIG. 2 is a perspective view of an alternative embodiment for holding a plurality of containers.
Figure 2A:
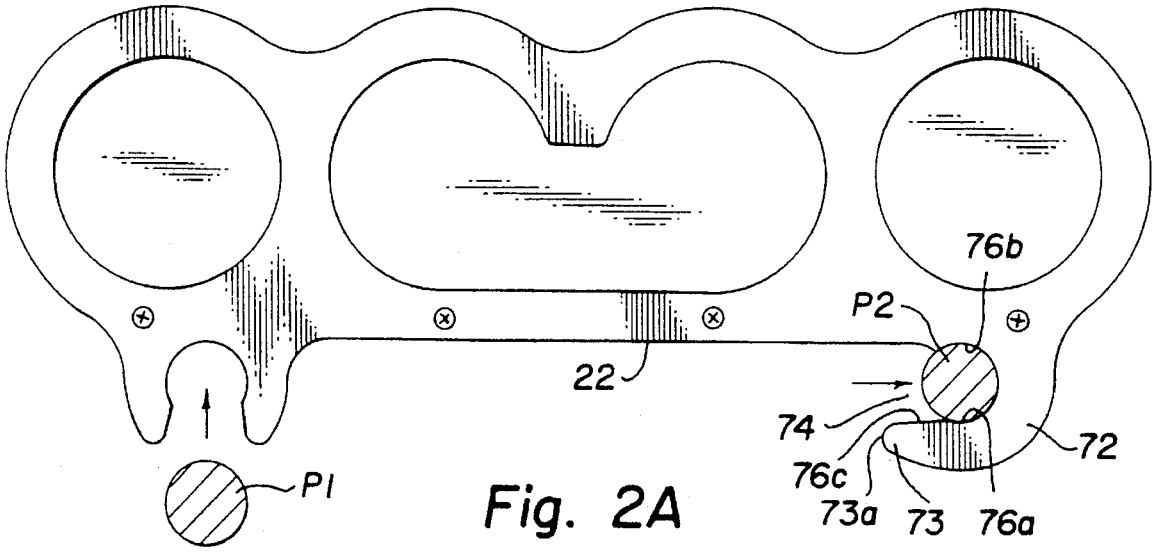
FIG. 2*a* is a top view of the alternative embodiment shown in FIG. 2.

An alternative embodiment, similar in construction to the preferred embodiment but adapted to mount to a pair of poles and to provide a plurality of container holders is illustrated in FIGS. 2 and 2*a*. Upper and lower; platforms 30 and 50 are secured using screws to upper and lower ends 26 and 28 of support plate 21. Upper platform 30 and lower platform 50 have finger pairs 36 and 56 forming a first clamp 100 as heretofore described.

Upper platform 30 further has a first resilient hook member 70 adapted for removably mounting the device to a second pole P2. The hook 70 extends perpendicularly from the first face 22 near the upper end 26 of support plate 21, and then curves to extend generally parallel with the first face 22. The hook has a body portion 72 with an end 73 thereon, and the hook 70 and first face 22 define a slot 74 therebetween. Slot wall portions 76*a* and 76*b* formed by the body portion 72 and the first face 22 are contoured to match a profile of the second pole P2.

In the preferred embodiment, the slot 74 is slightly narrower than the diameter of the pole p2. The slot wall portion 76*c* on end 73 diverge uniformly away from the first surface 22 as it extends towards an extreme end 73*a* from a clinch point 77. The distance between the slot walls at the clinch point 77 is slightly smaller than the diameter of the pole P2 and slot 74. The distance between the slot walls 76*c* and the first face 22 at extreme end 73*a* is larger than the diameter of pole P2.

The lower platform 50 includes a second hook member 78 generally identical to first hook member 70. The slots 74 in the hook members are aligned to form a second clamp 102 for mounting to the second pole P2 at two different places. Alternatively, the second clamp 102 can comprise a single hook. Such an embodiment can be made, for example, by eliminating either hook 70 or 78, or by eliminating both hooks and forming a hook integrally with the first face 22.

Upper platform 30 is elongated to accommodate a plurality of apertures 32*a* arranged in a linear fashion. Upper platform 30 can be enlarged in other directions as well to accommodate additional apertures arranged in other geometries. The first support flange 52 on lower platform 50 is similarly elongated and adapted to contact the bottom surface of a plurality of containers. The plurality of apertures are aligned with the elongated support flange to provide a plurality of container compartments 110.

Figure 3:
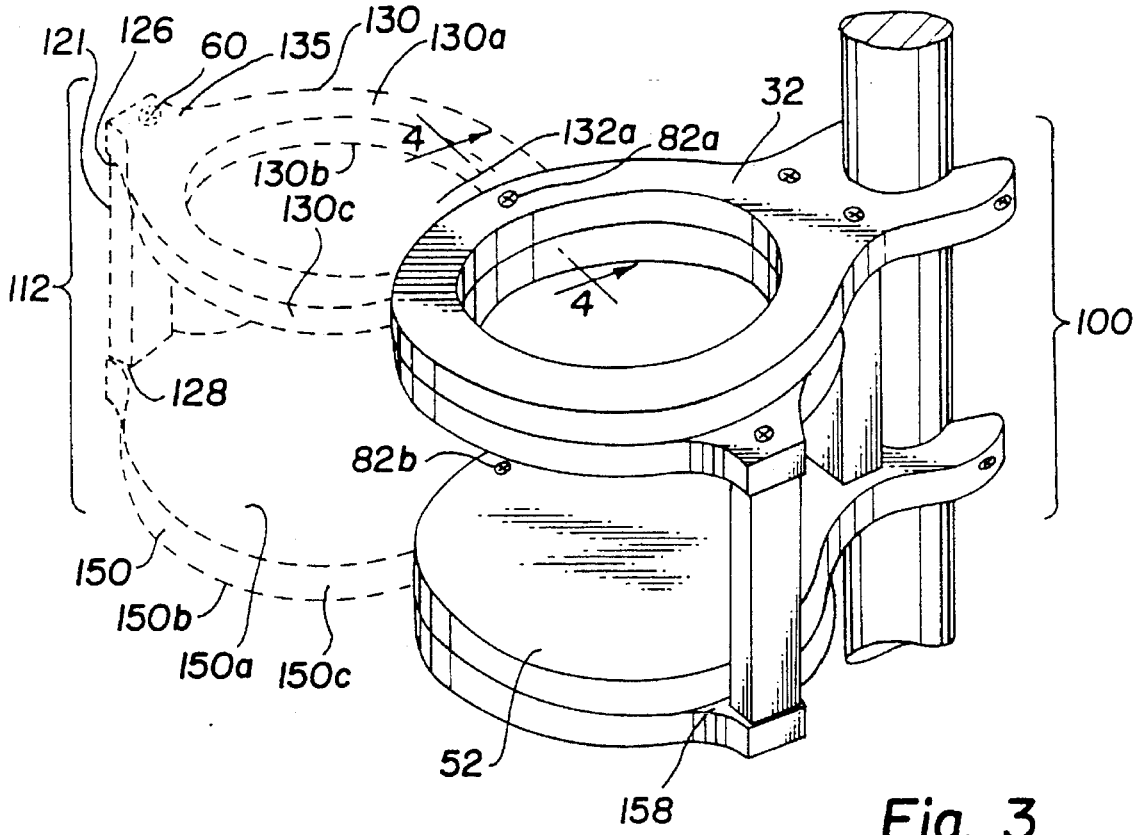
FIG. 3 is a perspective view of an alternative embodiment showing a pivoting container compartment attached to the preferred embodiment.

An alternative embodiment having a second container compartment 112 pivotally attached to the first container compartment 110 is illustrated in FIG. 3. The second container compartment 112 is comprised of a second retaining member 130, a second support flange 150, and a support column 121.

Support column 121 is preferably the same length as or slightly longer than support plate 21, and is provided with upper and lower ends 126 and 128.

The second retaining member 130 has an upper surface 130*a*, a lower surface 130*b*, and an exterior surface 130*c*. In the presently preferred embodiment, aperture 132*a* is the same size and shape as aperture 32*a* in first retaining member 32. However, the aperture 132*a* can be made in any size or shape desired. The exterior surface 130*c* is generally the same size and shape as the exterior surface 30*c* of the first retaining member 32. A flange 135 adapted for mounting to the upper end 126 of support column 121 extends from the exterior surface 130*c*.

Second support flange 150 is provided with an upper surface 150*a*, lower surface 150*b*, and exterior surface 150*c*. The exterior surface 150*c* is generally the same size and shape as the first exterior surface 50*c* on the first support flange 52. A flange 158 adapted for mounting to the lower end 128 of support column 121 extends from exterior surface 121. The upper surface 150*a* is adapted to contact the bottom surface of the container.

Second retaining member 130 and second support flange 150 are secured using screws 60 to the opposite ends 126 and 128 of the support column 121, and are aligned to form a second container compartment 112. Second container compartment 112 is pivotally attached to the first container compartment 110 using a screw 80*a* and locknut 80*b* or by any other means known to those skilled in the art, at attachment points 82*a* and 82*b*. The attachment points are located on the first container compartment 110 approximately ninety degrees from the first clamp 100. The attachment points are located on the second container compartment 112 approximately one-hundred-eighty degrees from the support column 121. Screws 80*a* extend through the attachment points 82*a* and 82*b* and extend into lock nuts 80*b*. The nuts 80*b* are torqued sufficiently to secure the container compartments to each other without restricting rotation of the second container holder 112 about the attachment points 82*a* and 82*b*.

The second container compartment 112 is positioned with the second retaining member 132 positioned below the first retaining member 32, and the second support flange 150 is positioned below the first support flange 52. Alternatively, second container compartment 112 can be attached with the second retaining member 130 and second support flange 150 positioned above the first retaining member 32 and first support flange 52.

Figure 4:
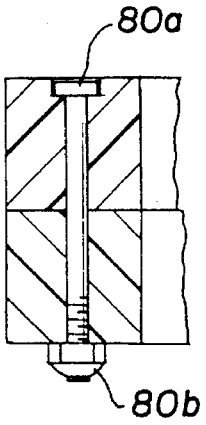
FIG. 4 is a sectional view taken along lines 4—4 in FIG. 3.
Figure 5:
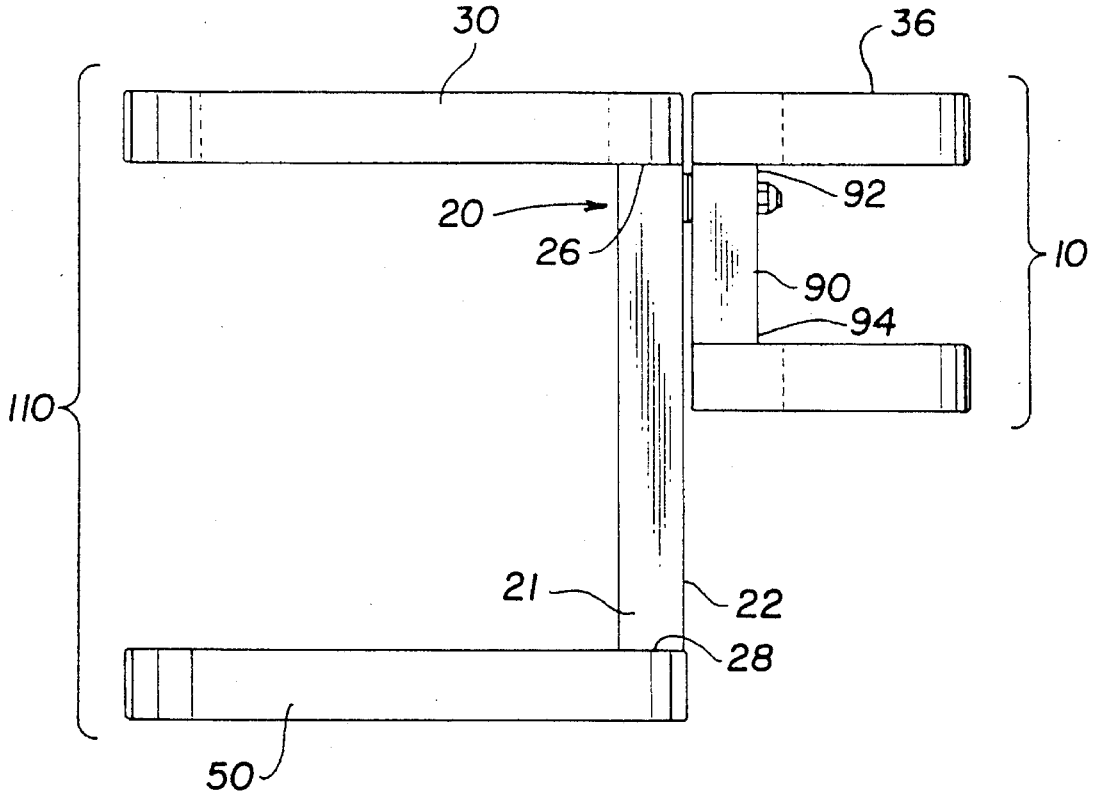
FIG. 5 is a side view of an alternative embodiment having a pivoting connector.
Figure 6:
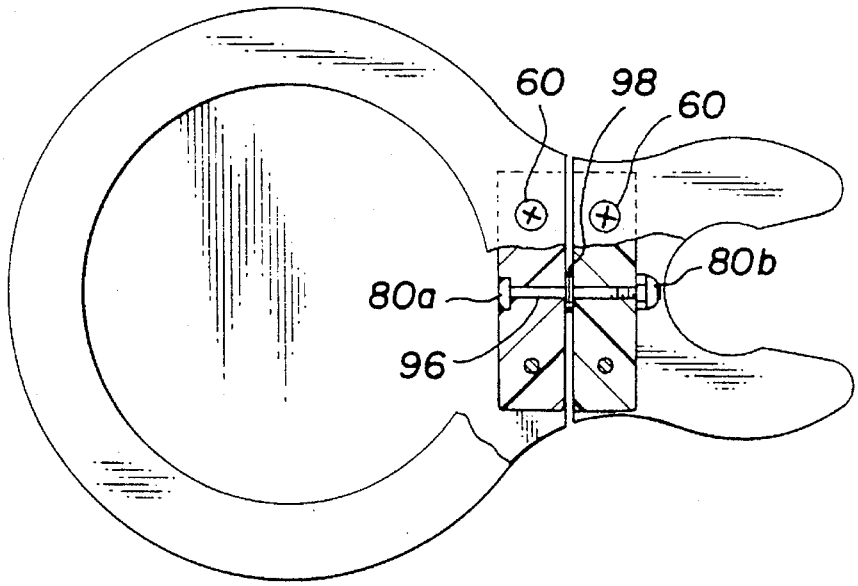
FIG. 6 is a top view of the embodiment of FIG. 5.

An alternative embodiment wherein first clamp 100 is pivotally attached to support plate 21 is illustrated in FIG. 4.

The frame 20 includes a pivot plate 90 having upper and lower ends 92 and 94 which is secured using a pivotal member 96 to first face 22 of support plate 21. In the presently preferred embodiment, the pivotal member 96 comprises a screw 80*a* and a locknut 80*b* which is torqued sufficiently to secure the pivot plate 90 to the support plate 21 without restricting rotation of the pivot plate 90 with respect to the support plate 21. A nylon washer 98 may be installed on the screw 80*a* between the support plate 21 and the pivot plate 90 to minimize the contact and friction force between the support plate 21 and the pivot plate 90.

Upper platform 30 is provided without finger pair 36, and lower platform 50 is provided without finger pair 56. Upper and lower platforms 30 and 50 are secured using screws 60 to opposite ends 26 and 28 of support plate 21 and are aligned to form a first container compartment 110 as heretofore described.

The first finger pair 36 is secured using screws 60 to the upper end 92 of the pivot plate 90, and a second finger pair 56 is secured using screws 60 to the lower end 94 of the pivot plate 90. The finger pairs are aligned to form a first clamp 100 for mounting to and gripping the pole P1 at two different places. A first clamp 100 with only one finger pair might also be used.

To install the device, the first clamp 100 is aligned with and placed against the first pole P1. Since the gap at extreme ends 48*a* and 48*b* is larger than the pole P1 diameter, the pole rests against the clinch points 46*a* and 46*b*, where the gap is slightly smaller than the pole P1 diameter. When sufficient force is applied to the device, in a direction towards the pole P1, the resilient fingers 36*a* and 36*b* bias outward to allow the pole P1 to pass by the clinch points 46*a* and 46*b* and move into the gap 40 between gap walls 42*a* and 42*b* which are contoured to match the profile of the pole P1. After the pole is in position against gap walls 42*a* and 42*b*, resilient restorative forces in the fingers 36*a* and 36*b* return the clinch points 46*a* and 46*b* to the position where the gap 40 between them is less than the diameter of the pole P1. In the presently preferred embodiment, the gap 40 between gap walls 42*a* and 42*b* is also smaller than the pole P1. The gap walls 42*a* and 42*b* and clinch points 46*a* and 46*b* thus provide an interference fit that secures the device 10 to the pole P1 and inhibits the device from sliding or rotating around the pole during normal use. The gap 40 can be sized to provide an interference fit that permits sliding or rotation upon application of an external force.

After the device is in place on the pole P1, the threaded connector 49*c* is inserted through the counter-bored hole 49*a* and into insert 49*b*. The clamping force generated by the interference fit between the gap walls 42*a* and 42*b* is supplemented by turning the threaded connector 49*c* to bias the finger ends 39*a* and 39*b* towards each other.

To install the device illustrated in FIGS. 2 and 2*a*, the second pole P2 is placed near the first face 22 of support plate 21. The device is moved in a direction parallel to the first face 22 until pole P2 rests against the clinch points 77 on the hook members 70 and 78 in the second clamp 102. Application of further force to the device in the same direction biases the clinch points 77 outward and allows the pole P2 to enter the slot 74 between slot wall portion 76*a* and 76*b*. Resilient force in the hooks 70 and 78 biases the contoured slot walls 76*a* and 76*b* into the pole P2 to provide an interference fit. After the second clamp 102 is installed onto the second pole P2, the first clamp 100 is installed onto the first pole P1 as heretofore described.

The device illustrated in FIGS. 4 and 4*a* is installed onto pole P1 as heretofore described, except that the orientation of the pole and anticipated movement of the pole is first taken into consideration. The first container compartment 110 is held in the vertical orientation while the pivot plate 90 is rotated to align the first clamp 100 with the pole P1. The first clamp 100 can be installed onto a pole oriented at any angle, while the first container compartment remains vertical, since the pivot plate 90 can rotate a full 360 degrees with respect to the first container compartment 110. This embodiment can also be mounted, if necessary, such that it is free to pivot to accommodate movement of the pole.

A container is placed in any of the described container compartments by inserting the container through the aperture until the bottom surface of the container contacts the upper surface of the support flange. The aperture walls restrict the movement of the container in directions perpendicular to the longitudinal axis, and the first support flange prevents the container from falling through the aperture.

The device illustrated in FIGS. 3*a* and 3*b* will hold one or two containers depending upon the relative positions of the first and second container compartments. In the first position, shown in FIG. 3*a*, the second container compartment 112 is aligned with the first container compartment 110, such that the apertures 32*a* and 132*a* are also in alignment. With the apertures aligned, the device will hold one container. When the second container compartment is rotated to the second position shown in FIG. 3*b*, the apertures are adjacent, and the device will hold two containers.

Although the invention has been described with reference to several embodiments, other embodiments can achieve the same results. Variations and modifications of the present invention will be apparent to those skilled in the art without departing from the scope and spirit of the invention, and it is intended to cover in the appended claims all such modifications and equivalents.

I claim:

1. A container holding device arranged for being removably mounted to poles having an outer surface profile, the container holding device comprising:

(a) a frame, a pivot plate, a pivotal member attaching said pivot plate to said first face of said plate, a first clamp, and a first container compartment;

(b) said frame comprising a support plate having thereon an upper and a lower end, and first and second oppositely disposed faces;

(c) said first clamp secured to said pivot plate, said first clamp comprising a first pair of adjacent fingers extending from the first face adapted for removably mounting the device to the pole, resilient body portions and end portions on said first pair of fingers, said body portions having a gap therebetween such that said body portions form walls contoured to match the outer surface profile of the pole; and (d) said first container compartment being formed by a first retaining member extending from said second face having an aperture therein with a longitudinal axis extending therethrough, and a first support flange extending from said second face, whereby when a container is installed in said first compartment, said first retaining member restricts the container's movement perpendicular to the longitudinal axis, and said first support flange contacts a bottom surface of the container.

2. A device as defined in claim 1 wherein an adjustable threaded member connects said end portions, whereby when said first clamp is mounted to the pole, adjustment of said threaded member applies incremental bending force to said end portions to bias them in a direction of the pole.

3. A device as defined in claim 1, wherein said first clamp includes a second pair of adjacent fingers in alignment with said first pair of fingers for clamping to the pole.

4. A device as defined in claim 1, wherein said first clamp includes a second pair of adjacent fingers in alignment with said first pair of fingers for clamping to the first pole, said first and said second pair of fingers being mounted to opposite ends of said pivot plate.

5. A container holding device arranged to be removably mounted to first and second poles having outer surface profiles, the container holding device comprising:

a support plate forming a frame having upper and lower ends and first and second oppositely disposed faces;

a first clamp having a first pair of adjacent fingers extending from said first face of said frame, said first pair of fingers being adapted for removably mounting said frame to the first pole, resilient body portions and end portions on said first pair of fingers, said resilient body portions having a gap therebetween such that said body portions form walls contoured to match the outer surface profile of the first pole;

a second clamp extending from said first face of said support plate, said second clamp having a resilient hook member spaced from said first face of said support plate forming a slot, said hook member having a surface bounding a portion of the slot contoured to match the outer profile of the second pole;

a retainer member extending from said second face of said support plate, said retaining member having an aperture formed therethrough with a longitudinally extending axis; and a support flange extending from said second face of said support plate, whereby when a container is installed in said first compartment, said retaining member restricts movement of the container perpendicular to the longitudinal axis and said support flange contacts a bottom surface of the container.

6. A device as defined in claim 5, wherein said second clamp includes a second hook member aligned with the first hook member for clamping to the second pole.

7. A container holding device arranged for being removably mounted to poles having an outer surface profile comprising:

(a) a frame, a first clamp, and a first container compartment;

(b) said frame comprising a support plate having thereon an upper and a lower end, and first and second oppositely disposed faces;

(c) said first clamp comprising a first pair of adjacent fingers extending from the first face adapted for removably mounting the device to the pole, resilient body portions and end portions on said first pair of fingers, said body portions having a gap therebetween such that said body portions form walls contoured to match the outer surface profile of the pole;

(d) said first container compartment being formed by a first retaining member extending from said second face having an aperture therein with a longitudinal axis extending therethrough, and a first support flange extending from said second face, whereby when a container is installed in said first compartment, said first retaining member restricts the container's movement perpendicular to the longitudinal axis, and said first support flange contacts a bottom surface of the container; and (e) a second container compartment comprising a second retaining member having an aperture therein extending from an end of a support column and a second support flange extending from an opposite end of said support column, said second compartment being pivotally attached to said first compartment and moveable between a first position wherein said apertures are aligned and a second position wherein said apertures are offset, whereby when it is desired to store one container in the device said second compartment can be moved to the first position, and when it is desired to store two containers in the device said second compartment can be moved to the second position.

8. A container holding device arranged for being removably mounted to poles having an outer surface profile, the container holding device comprising:

(a) a frame, a first clamp, and a first container compartment;

(b) said frame comprising a support plate having thereon an upper and a lower end and first and second oppositely disposed faces;

(c) said first clamp comprising a first pair of adjacent fingers extending from the first face adapted for removably mounting the device to the pole, resilient body portions and end portions on said first pair of fingers, said body portions having a gap therebetween such that said body portions form walls contoured to match the outer surface profile of the pole;

(d) said first container compartment being formed by a first retaining member extending from said second face having an aperture therein with a longitudinal axis extending therethrough, and a first support flange extending from said second face, whereby when a container is installed in said first compartment, said first retaining member restricts the container's movement perpendicular to the longitudinal axis, and said first support flange contacts a bottom surface of the container; and (e) a second container compartment comprising a support column, a second retaining member with an aperture therein, and a second support flange, said second container compartment is pivotally attached to said first compartment and moveable between a first position and a second position, said apertures are aligned when said second compartment is in the first position and offset when said second compartment is in the second position, whereby one container can be stored in the device when said second container compartment is in the first position, and two containers can be stored in the device when the second container compartment is in the second position.

* * * * *